US011033927B1

(12) United States Patent
Oliver

(10) Patent No.: US 11,033,927 B1
(45) Date of Patent: Jun. 15, 2021

(54) PAINT ROLLER WRIST RELIEF DEVICE

(71) Applicant: David Oliver, Canyon Lake, CA (US)

(72) Inventor: David Oliver, Canyon Lake, CA (US)

( * ) Notice: Subject to any disclaimer, the term of this patent is extended or adjusted under 35 U.S.C. 154(b) by 14 days.

(21) Appl. No.: 16/359,858

(22) Filed: Mar. 20, 2019

Related U.S. Application Data

(60) Provisional application No. 62/731,952, filed on Nov. 29, 2018.

(51) Int. Cl.
*B05C 17/02* (2006.01)

(52) U.S. Cl.
CPC ..... *B05C 17/0245* (2013.01); *B05C 17/0205* (2013.01)

(58) Field of Classification Search
USPC ..... 15/143.1, 144.1, 230.11; 118/258
See application file for complete search history.

(56) References Cited

U.S. PATENT DOCUMENTS 9,649,656 B2 * 5/2017 Brooks ..... B05C 17/0205
2002/0157215 A1 * 10/2002 Carman ..... A01B 1/00 16/430
2006/0179592 A1 * 8/2006 Landers ..... B05C 17/0205 15/143.1
2011/0314639 A1 * 12/2011 Herigstad ..... B25G 1/102 16/421

* cited by examiner

*Primary Examiner* — Yewebdar T Tadesse
(74) *Attorney, Agent, or Firm* — William A. English; Vista IP Law Group LLP

(57) ABSTRACT

A device is provided for supporting a wrist of a user holding a paint roller including a handle, a frame extending from the handle along a longitudinal axis, and a roller wheel carried by the frame opposite the handle, the device including a base portion including one or more connectors for coupling the base portion to the handle of the paint roller, and a rigid support member extending laterally from the base portion, the support member comprising a curved surface for at least partially surrounding a wrist of a user holding the handle to support the wrist.

18 Claims, 6 Drawing Sheets

PAINT ROLLER WRIST RELIEF DEVICE

RELATED APPLICATION DATA

The present application claims benefit of U.S. provisional application Ser. No. 62/731,952, filed Nov. 29, 2018, the entire disclosure of which is expressly incorporated by reference herein.

FIELD OF THE INVENTION

The present invention relates to devices for supporting a user holding a device, such as a paint roller, and, more particularly, to wrist support devices that may be coupled to or integrated into a paint roller and to methods for making and using such devices.

BACKGROUND

Paint rollers are commonly known devices that include a handle supporting a frame carrying a roller wheel to which individual conventional paint rollers may be attached. The roller may be rolled in a tray of paint, and the paint may then be manually applied to a surface, e.g., a wall, ceiling, and the like by pushing the roller back and forth while holding the handle. Once the paint on the roller is depleted, the user may obtain more paint from the tray and repeat the motion to apply the paint over the desired surface. Given the weight of the paint-drenched roller, when the user extends their arm outwardly and/or upwardly to apply the paint to the surface, the user's arm and particularly wrist may be subjected to substantially forces, which may cause fatigue, pressure, pain, and potential injury.

Accordingly, devices that may relieve pressure from the wrist while painting would be useful.

SUMMARY

The present invention is directed to devices for supporting a user holding a device, such as a paint roller, and more particularly to wrist support devices that may be coupled to or integrated into a paint roller and to methods for making and using such devices.

In accordance with an exemplary embodiment, a device is provided for supporting a wrist of a user holding a paint roller including a handle, a frame extending from the handle along a longitudinal axis, and a roller wheel carried by the frame opposite the handle, the device including a base portion including one or more connectors for coupling the base portion to the handle of the paint roller, and a rigid support member extending laterally from the base portion, the support member comprising a curved surface for at least partially surrounding a wrist of a user holding the handle to support the wrist.

In an exemplary embodiment, the support member is a "C" shaped member defining an arc that curves away from the longitudinal axis such that the curved surface defines a recess for receiving a wrist of the user holding the handle. In another exemplary embodiment, the one or more connectors may include a nipple extending from the first end of the base portion including one more helical threads, ratchet elements, and the like for engaging with corresponding features on the handle to secure the device to the handle of a paint roller.

In accordance with another embodiment, a paint roller device is provided that includes a paint roller comprising a handle, a frame extending from the handle along a longitudinal axis, and a roller wheel carried by the frame opposite the handle; and a rigid support member extending laterally from the handle, the support member comprising a curved surface for at least partially surrounding a wrist of a user holding the handle to support the wrist.

Other aspects and features of the present invention will become apparent from consideration of the following description taken in conjunction with the accompanying drawings.

BRIEF DESCRIPTION OF THE DRAWINGS

These and other features, aspects, and advantages of the present disclosure will become better understood with regard to the following description, appended claims, and accompanying drawings where:

DETAILED DESCRIPTION OF THE EXEMPLARY EMBODIMENTS

In the following description, numerous details are set forth in order to provide a more thorough description of examples of the devices. It will be apparent, however, to one skilled in the art, that the disclosed devices may be practiced without these specific details. In the other instances, well known features have not been described in detail so as not to unnecessarily obscure the devices shown.

Figure 1:
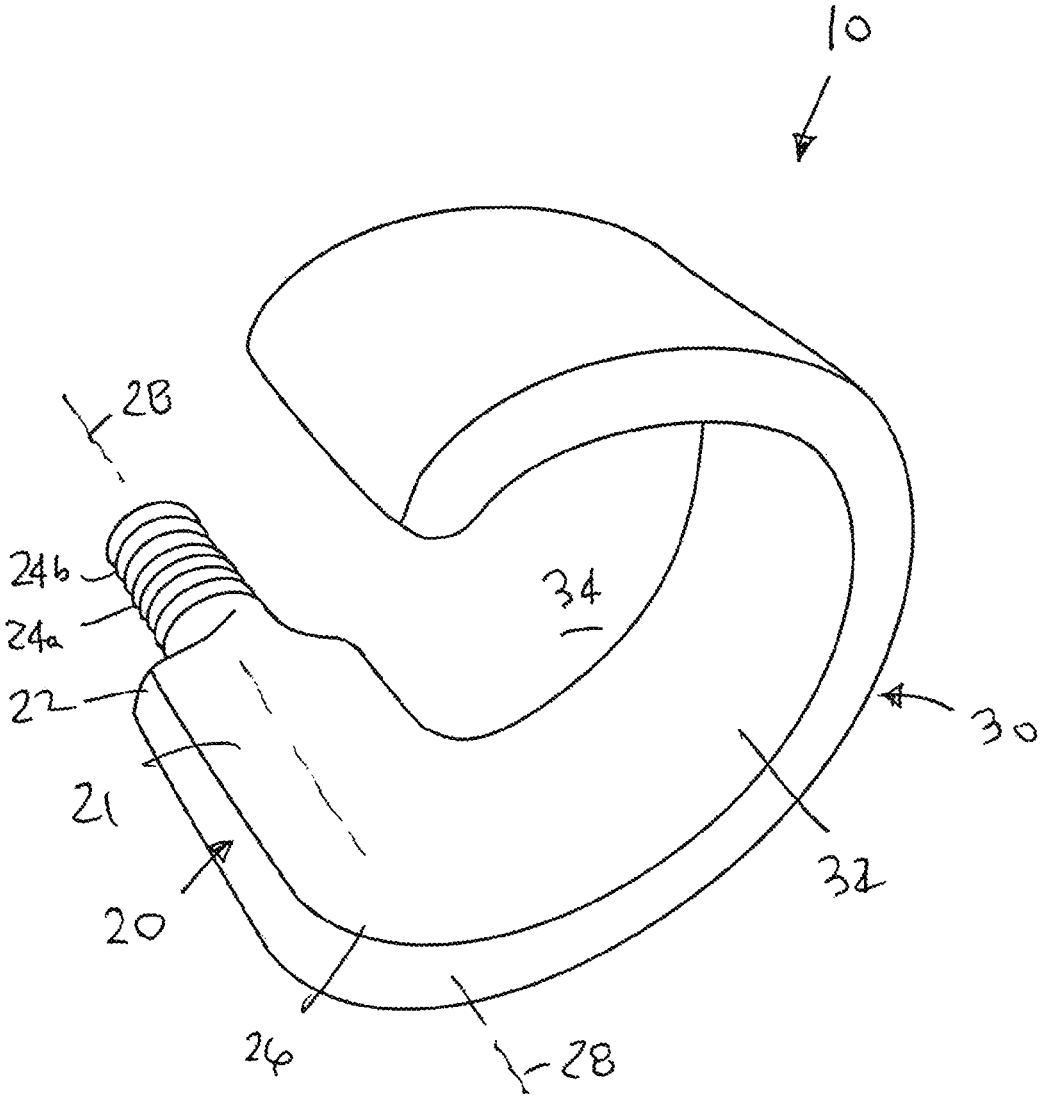
FIG. 1 is a perspective view of an exemplary embodiment of a wrist support device.

Turning to FIGS. 1-2, an exemplary embodiment of a device 10 is shown for supporting a wrist of a user (not shown) holding a paint roller. For example, FIG. 3 shows an example of a paint roller 40 to which the device 10 may be coupled, including a handle 50, a frame 60 extending from the handle along a longitudinal axis 62, and a roller wheel 70 carried by the frame opposite the handle 50 onto which a paint roller (not shown) may be mounted during use.

Returning to FIGS. 1-2, the device 10 generally includes a hub or base portion 20 including one or more connectors for coupling the device 10 to a handle 50 of the paint roller 40, and a support member 30 extending laterally from the base portion 20 and configured to at least partially surrounding a wrist or forearm of a user holding the handle 50. The base portion includes a first end 22 including one or more connectors 24 for coupling the device 10 to the handle 50 and a second free end 26 opposite the first end 22, thereby defining an axis 28 between the first and second ends 22, 26.

In the embodiment shown, the one or more connectors 24 includes a nipple 24*a* aligned with the axis 28 including one or more external helical threads 24*b*. For example, the nipple 24*a* may be sized to be received in a corresponding recess 52 in the handle 50, which may include one or more internal helical threads therein corresponding to the threads 24*b*, e.g., such that the device 10 may be coupled to the handle 50 by threading the nipple 24*a* into the recess. In this manner, the device 10 may be fixed relative to the handle 50 but may be removed, if desired.

Alternatively, other connectors may be provided. For example, a collar may be provided on the first end 22 of the base portion 20 that includes internal threads (not shown), and the handle 50 may include a nipple with external threads (also not shown). In another alternative, the nipple 24*a* may include one or more detents or ratchet elements (not shown) that may snap into or over corresponding features on the handle 50. In a further alternative, the base portion 20 may be permanently coupled to the handle 50, e.g., integrally molded or otherwise formed together, as described elsewhere herein.

Figure 2B:
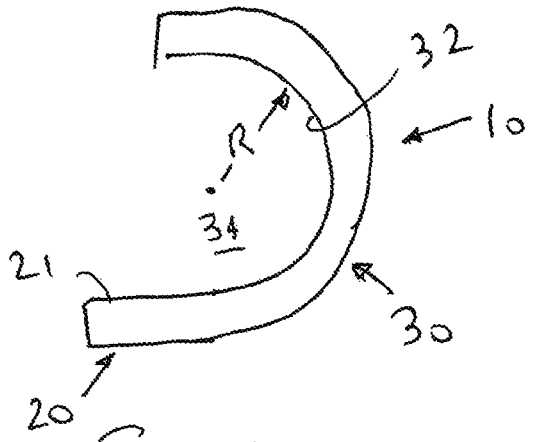
FIGS. 2A and 2B are side and ends views, respectively, of the device of FIG. 1.
Figure 3:
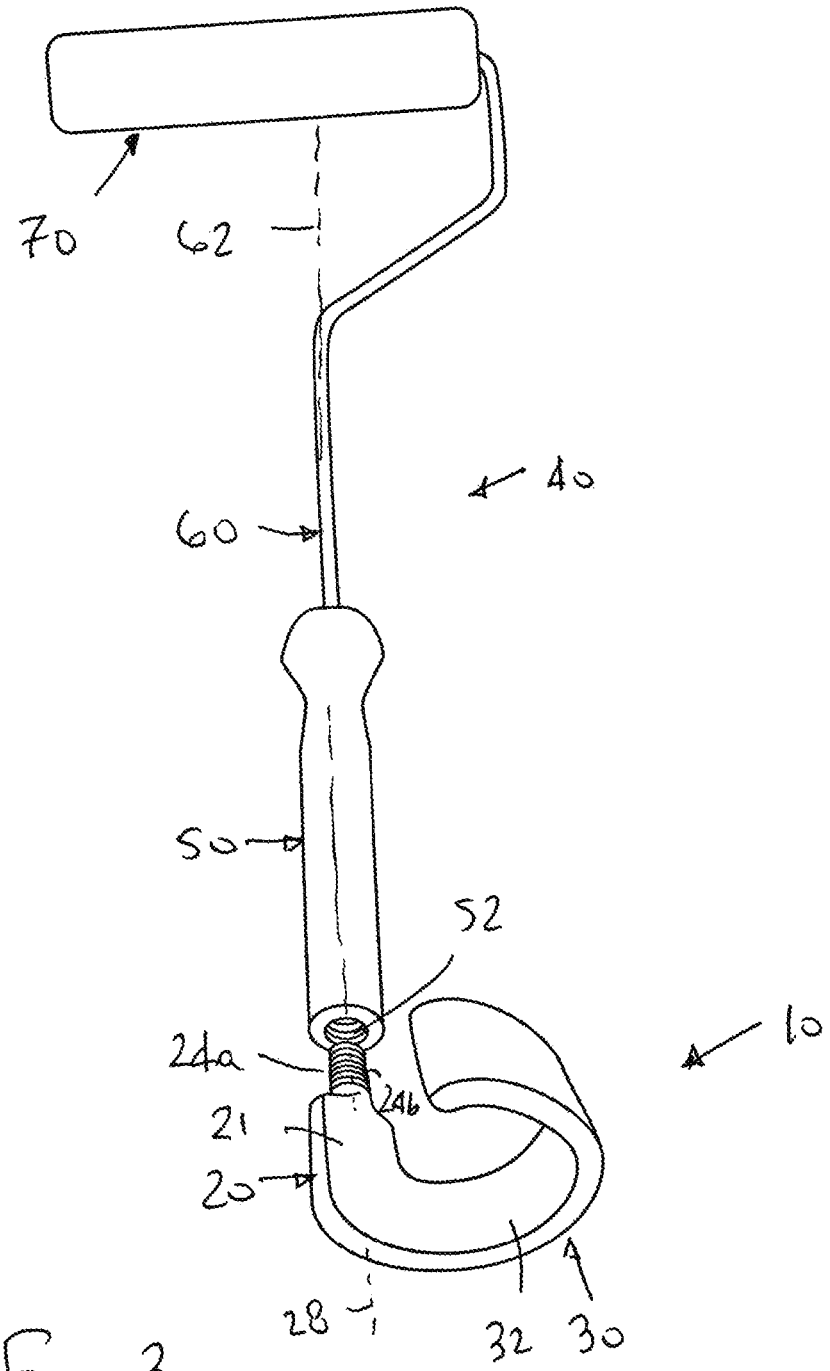
FIG. 3 is a perspective view of the device of FIG. 1 coupled to the handle of a paint roller.

As best seen in FIG. 2B, the support member 30 is a "C" shaped member defining an arc that curves radially away from the axis 28 such that an inner curved surface 32 thereof defines a recess 34 adjacent the base portion 20 that receives a wrist or forearm of the user holding the handle 50. For example, the base portion 20 may define a substantially planar surface 21 that extends between the first and second ends 22, 26, and the support member 30 may extend from the base portion 20 such that the curved surface 32 curves away from the planar surface 21 and/or away from the axis 28 such that the planar surface 21 and curved surface 32 together define the recess 34. Optionally, a cushion or padding material (not shown) may be provided on the planar surface 21 and/or the curved surface 32, e.g., to provide comfort to the user's wrist and/or forearm and/or to prevent the device 10 from slipping when in use.

The support member 30 may define an arc greater than ninety degrees (90°), e.g., between ninety and two hundred seventy degrees (90-270°), or about one hundred eighty degrees (180°) such that the recess 34 can secure the wrist or forearm of the user therein when the handle 50 is held. The inner surface 32 of the support member 30 may generally surround a central axis defining a substantially uniform radius or variable radius "R," e.g., not more than about 1.5-3 six inches (15.0 cm), e.g., between about 1.5 and three inches (3-8-7.5 cm), e.g., as shown in FIG. 2B.

Optionally, the support member 30 may have a more complicated curvilinear shape, for example, including a curved portion extending from the base portion 20 defining a concave inner surface 32, e.g. curving about one hundred eighty degrees (180°), and then straightening or curving in the opposite direction to provide a space to facilitate receiving a wrist or forearm in the recess 34.

Figure 2A:
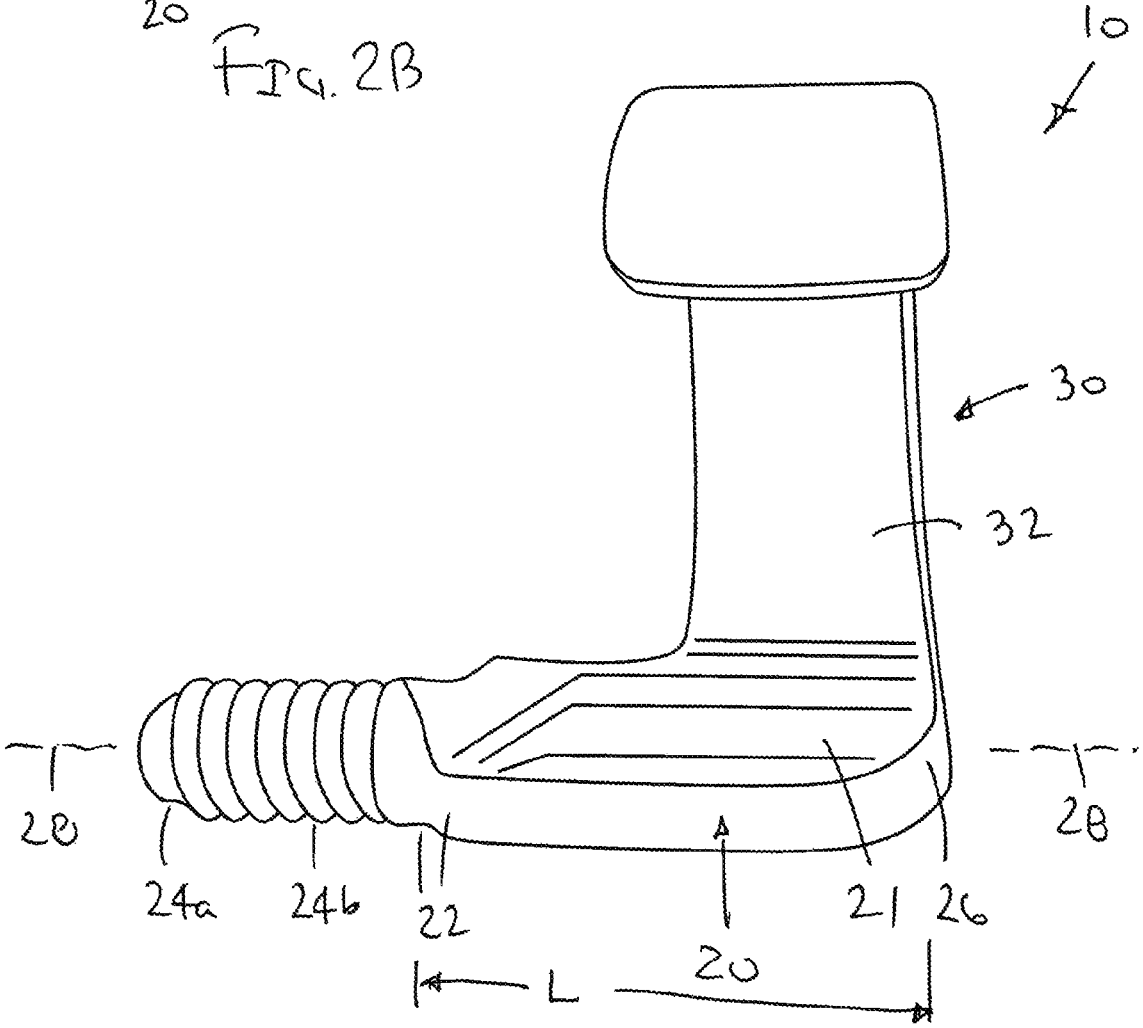

As best seen in FIG. 2A, the base portion 20 generally has a relatively short length "L" between its first and second ends 22, 26, e.g., such that the support member 30 is located immediately adjacent the handle 50 when the device 10 is coupled to a paint roller 40. For example, the length "L" may be not more than about six inches (15.0 cm), or not more than four inches (10.0 cm), or not more than about three inches (7.5 cm). The curved surface 32 of the support member 30 may then have a width (defined as parallel to the length "L" and the axis 28) smaller than the length "L," while providing the support member 30 immediately adjacent the handle 50.

Figure 4:
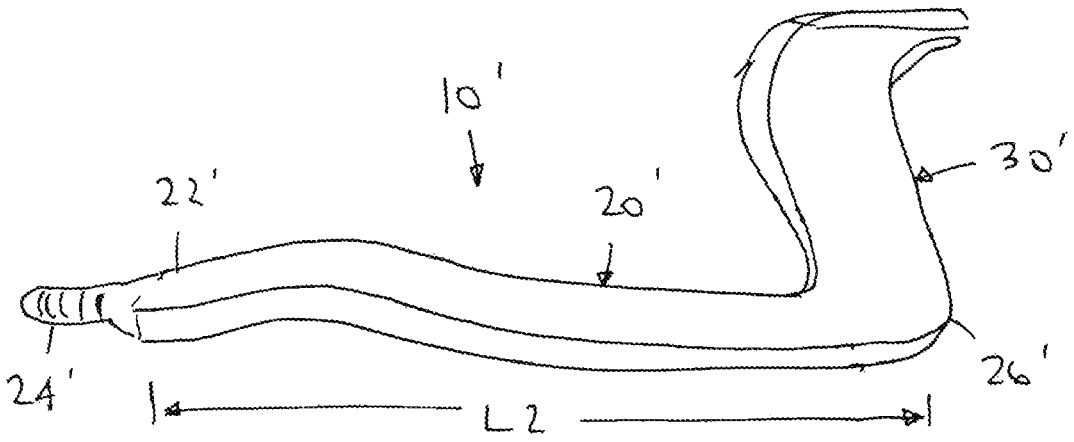
FIG. 4 is a perspective view of another embodiment of a wrist support device.

Alternatively, the base portion 20 may have a longer length to provide the support member further from the handle. For example, in FIG. 4, a support device 10' is shown that includes a base portion 20' having a much longer length "L2," e.g., between about six and twelve inches (15-30 cm), with the support member 30' provided adjacent the second free end 26' of the base portion 20.' The support member 30' may have a similar shape and/or construction to the support member 30, but may be provided at a location to surround a region of the user's forearm, e.g., adjacent the elbow.

Figure 5A:
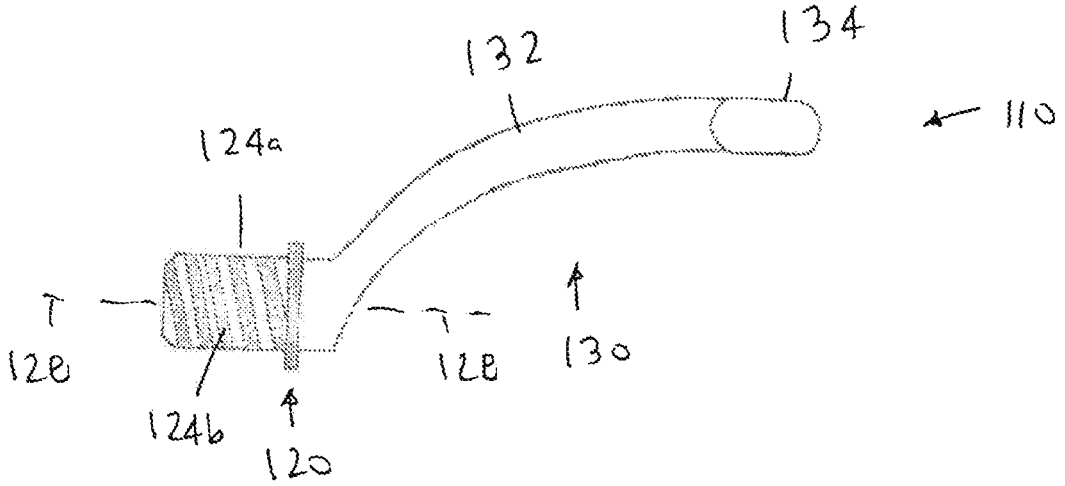
FIGS. 5A-5C are side, top, and perspective views, respectively, of yet another embodiment of a wrist support device.
Figure 5B:
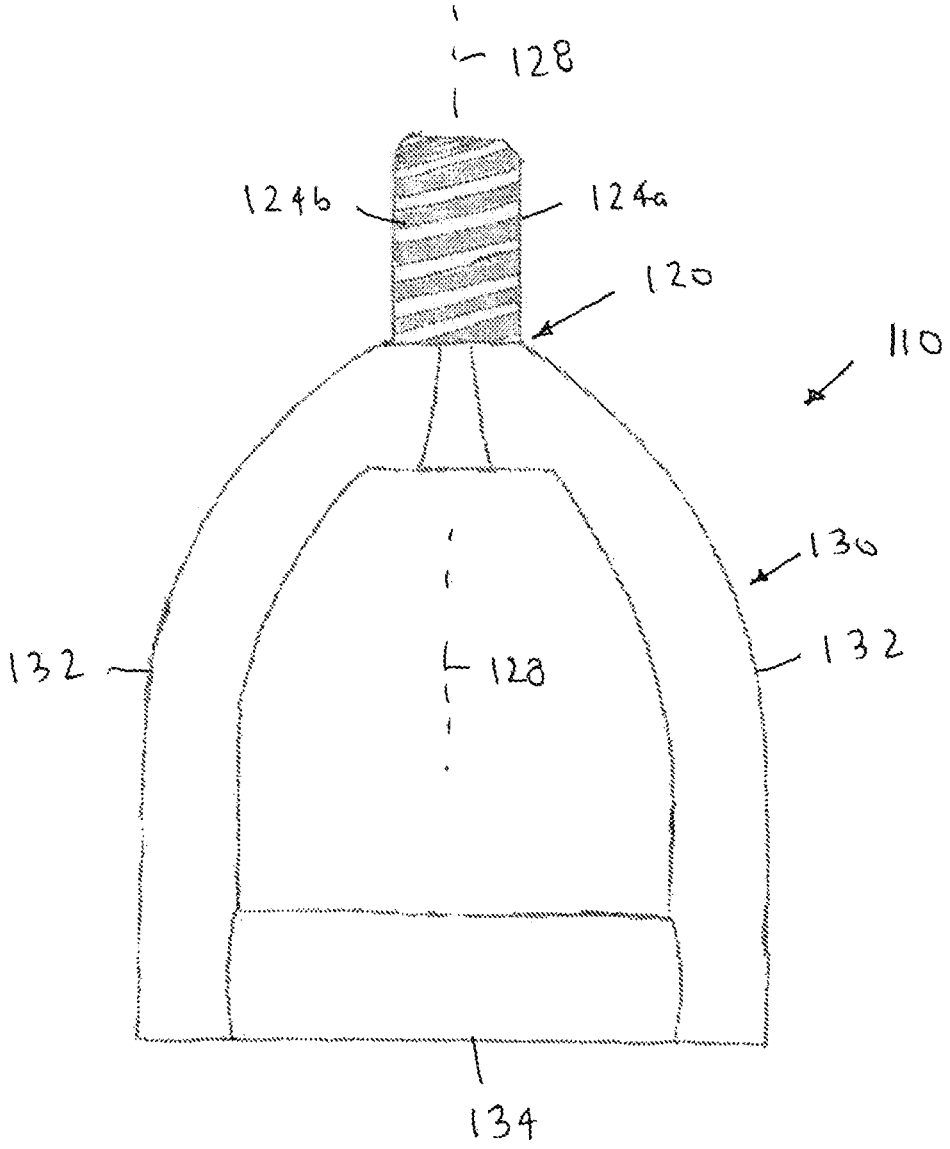
Figure 5C:
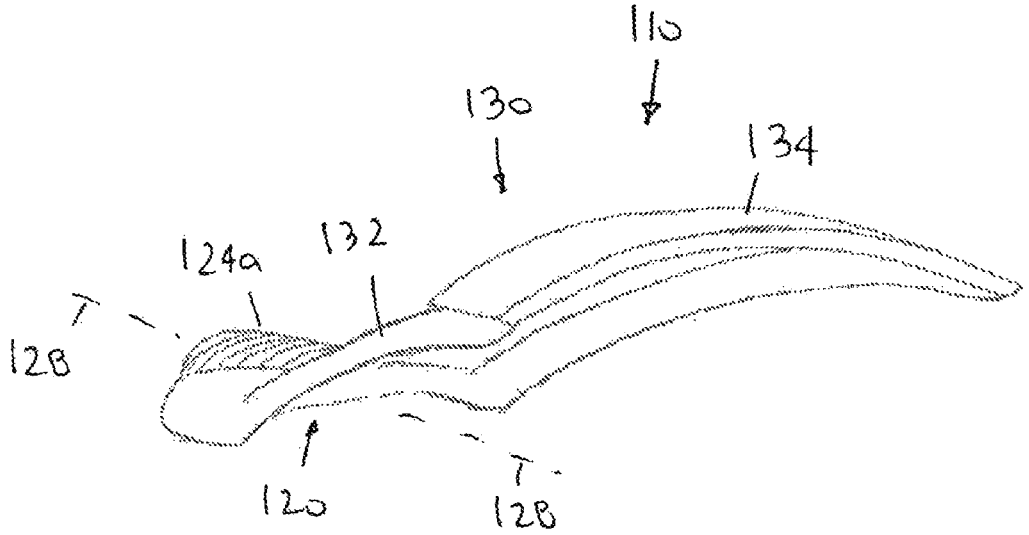

Turning to FIGS. 5A-5C, another embodiment of a support device 110 is shown that includes a hub or base portion 120 and a support member 130 extending from the base portion 120. The base portion 120 may include one or more connectors, e.g., a nipple 124*a* including threads 124*b*, similar to other embodiments herein, to couple the device 110 to a handle of a paint roller (not shown).

Unlike the previous embodiments, the support member 130 includes a pair of arms 132 extending from the base portion 120, e.g., defining a generally "Y" shape, and a curved support 134 extending between ends of the arms 132. As best seen in FIG. 5A, the base portion 120 may define an axis 128 and the arms 132 may curved away from the axis 128, and the support 134 may define an arc between the arms 132 to accommodate receiving a portion of a user's forearm (not shown) between the arms 132 when the user holds the handle of a paint roller to which the device 110 has been coupled.

Returning to FIG. 1, the device 10 (and any of the other support devices herein) may be integrally formed as a single piece including the base portion 20 and the support member 30. For example, the device 10 may be formed by molding, three-D printing, casting, machining, and the like, e.g., from plastic, fiberglass, metal, or composite materials. Alternatively, the device 10 may be integrated directly into the handle of a paint roller. For example, the handle of a conventional paint roller may be extended sufficient length to accommodate integrating a support member into the handle itself, thereby providing a custom-designed paint roller.

Turning to FIG. 3, during use, the device 10 (or any of the other support devices herein) may be provided to a user who may couple the device to a handle 50 of a paint roller 40. For example, as described above, the nipple 24*a* may be threaded into the handle 50 of the paint roller 40 until secure. The user may then use the paint roller normally, e.g., roll the paint roller in a tray of paint, and then user the roller to manually apply the paint to a surface, e.g., a wall, ceiling. Because the support member 30 extends at least partially around the wrist of the user, the weight of the paint roller is distributed up the forearm of the user, thereby minimizing localizer pressure to the wrist that may reduce fatigue, paint, and injury. Thus, a user may be able to paint longer and/or using wider paint rollers (holding greater amounts of paint, with the additional weight supported by the user's arm).

In addition, the support member 30 may contact the user's forearm immediately adjacent the wrist, which may stabilize the paint roller 40 during use. Consequently, the user may be able to use greater pressure when applying paint to a surface with less pressure being born by the wrist.

It will be appreciated that elements or components shown with any embodiment herein are exemplary for the specific embodiment and may be used on or in combination with other embodiments disclosed herein.

While the invention is susceptible to various modifications, and alternative forms, specific examples thereof have been shown in the drawings and are herein described in detail. It should be understood, however, that the invention is not to be limited to the particular forms or methods disclosed, but to the contrary, the invention is to cover all modifications, equivalents and alternatives falling within the scope of the appended claims.

I claim:

1. A device for supporting a wrist of a user holding a paint roller including a handle, a frame extending from the handle along a longitudinal axis, and a roller wheel carried by the frame opposite the handle, the device comprising:

a substantially straight base portion including a first end and terminating at a second end opposite the first end, and one or more connectors on the first end for coupling the substantially straight base portion to the handle of the paint roller, the substantially straight base portion a base portion axis between the first end and the second end aligned with the longitudinal axis and having a length from the first end to the second end that is not more than about six inches; and a rigid support member extending from the substantially straight base portion substantially perpendicular to the base portion axis, the rigid support member curving partially back towards the substantially straight base portion to define a curved surface for at least partially surrounding a wrist or forearm of a user holding the handle to support the wrist.

2. The device of claim 1, wherein the rigid support member is a "C" shaped member defining an arc that curves away from the base portion axis such that the curved surface defines a recess for receiving a wrist or forearm of the user holding the handle.

3. The device of claim 1, wherein the one or more connectors comprise a nipple extending from the first end of the substantially straight base portion and aligned with the base portion axis, the nipple including one more helical threads for engaging with corresponding threads on the handle.

4. The device of claim 1, wherein the substantially straight base portion has a length between the first and second ends that is not more than four inches.

5. The device of claim 4, wherein the curved surface has a width parallel with the base portion axis that is smaller than the length of the base portion.

6. The device of claim 1, wherein the substantially straight base portion defines a substantially planar surface extending between the first and second ends that is disposed adjacent the curved surface.

7. The device of claim 1, wherein the curved surface generally defines a radius of not more than six inches.

8. The device of claim 1, wherein the substantially straight base portion and the rigid support member are integrally formed together.

9. The device of claim 8, wherein the substantially straight base portion and the rigid support member are formed from one of plastic, fiberglass, or composite material.

10. The device of claim 1, wherein the substantially straight base portion defines a substantially planar surface extending between the first end and the second end, and wherein the curved surface of the support member extends away from the substantially planar surface such that the substantially planar surface and the curved surface together define a recess for a wrist or forearm of a user holding the handle.

11. A device for supporting a wrist of a user holding a paint roller including a handle, a frame extending from the handle along a longitudinal axis, and a roller wheel carried by the frame opposite the handle, the device comprising:

a substantially straight base portion including a substantially planar surface extending along a base portion axis aligned with the longitudinal axis between first and second ends of the substantially straight base portion and one or more connectors on the first end for coupling the substantially straight base portion to the handle of the paint roller, the base portion terminating at the second end and having a length between the first and second ends that is not more than about six inches; and a rigid support member extending laterally from the substantially straight base portion, the rigid support member curving partially back towards the base portion to define a concave curved surface extending from the substantially planar surface such that the substantially planar surface and the concave curved surface define a recess for at least partially surrounding a wrist or forearm of a user holding the handle to support the wrist.

12. The device of claim 11, wherein the one or more connectors comprise one or more helical threads.

13. The device of claim 11, wherein the rigid support member extends from the second end of the substantially straight base portion substantially perpendicular to the base portion axis and curves partially back towards the base portion axis to define a "C" shape cross-section.

14. A device for supporting a wrist of a user holding a paint roller including a handle, a frame extending from the handle along a longitudinal axis, and a roller wheel carried by the frame opposite the handle, the device comprising:

a hub including a first end and terminating at a second end extending along a hub axis aligned with the longitudinal axis, the hub comprising a nipple on the first end including one or more connectors for coupling the hub to the handle of the paint roller; and a support member extending from the hub substantially perpendicular to the hub axis and curving partially back towards the hub such that a surface of the hub and a curved surface of the support member together define a recess for at least partially surrounding a wrist or forearm of a user holding the handle.

15. The device of claim 14, wherein the support member is a "C" shaped member.

16. The device of claim 14, wherein the one or more connectors comprise one or more helical threads on the nipple configured to be received in a similarly threaded recess in the handle.

17. The device of claim 14, wherein the hub has a length between the first end and the second end that is not more than six inches.

18. The device of claim 14, wherein the surface of the hub is substantially planar.

* * * * *